US006173592B1

(12) United States Patent
Yu

(10) Patent No.: US 6,173,592 B1
(45) Date of Patent: Jan. 16, 2001

(54) LOCK FOR SUITCASE

(76) Inventor: Chun Te Yu, No. 253, Section 3, Yen-Hi Rd., Fu-Shin Shang, Chang-Hwa Hsien (TW)

( * ) Notice: Under 35 U.S.C. 154(b), the term of this patent shall be extended for 0 days.

(21) Appl. No.: 09/330,185

(22) Filed: Jun. 11, 1999

(51) Int. Cl.[7] ..... E05B 65/52
(52) U.S. Cl. ..... 70/69; 70/74; 70/312
(58) Field of Search ..... 70/69–75, 312

(56) References Cited

U.S. PATENT DOCUMENTS

| | | | | |
|---|---|---|---|---|
| 2,820,359 | * | 1/1958 | Levine | 70/69 |
| 3,121,318 | * | 2/1964 | Norrenberg-Sudhaus | 70/69 |
| 3,405,544 | * | 10/1968 | Gehrie | 70/74 |
| 3,416,338 | * | 12/1968 | Gehrie | 70/69 X |
| 3,436,938 | * | 4/1969 | Walters | 70/70 |
| 4,155,234 | * | 5/1979 | Bako | 70/70 X |
| 4,719,776 | * | 1/1988 | Molnar | 70/70 X |
| 4,819,466 | * | 4/1989 | Werner | 70/70 |
| 4,852,372 | * | 8/1989 | Ling | 70/74 X |
| 4,920,771 | * | 5/1990 | Jiang | 70/75 X |
| 4,926,663 | * | 5/1990 | Azzalin | 70/74 |
| 5,211,040 | * | 5/1993 | Gisiger | 70/71 |
| 5,237,842 | * | 8/1993 | Rasch et al. | 70/69 X |
| 5,307,654 | * | 5/1994 | Ling | 70/75 X |
| 5,438,853 | * | 8/1995 | Bartsch | 70/69 |
| 5,485,734 | * | 1/1996 | Yang | 70/71 X |

* cited by examiner

*Primary Examiner*—Suzanne Dino Barrett
(74) *Attorney, Agent, or Firm*—Rosenberg, Klein & Lee

(57) ABSTRACT

A lock for a suitcase includes a base on the base portion of the suitcase and an engaging part on the cover of the suitcase. The base has an aperture for retaining a hook on the engaging part. The base has two setting disks each have a notch and a control frame in the base has two protrusions disengagably received in the two notches. The control frame is connected to a retaining member which has a pin inserted into the aperture so that when the protrusions are received in the notches of the setting disks, the control frame and the retaining member are shifted to let the pin be removed from the aperture. A block is inserted into the aperture by rotating a setting member and the block has a thumb which stops a lug on the control frame when the protrusions are received in the notches so that two number disks mounted to the setting disks can be freely rotated to set another locking code.

6 Claims, 10 Drawing Sheets

LOCK FOR SUITCASE

FIELD OF THE INVENTION

The present invention relates to a lock for a suitcase, and more particularly, to a lock which can be opened by one hand and has a setting device which prevents persons having no permission to change the lock code.

BACKGROUND OF THE INVENTION

A conventional suitcase lock is shown in FIGS. 1 and 2 and includes a base (100) on the base portion (200) of the suitcase and an engaging part (101) on the cover (201) of the suitcase. The base (100) has an aperture (102) defined therein which is designed to receive a locking frame (103) extending from the engaging part (101). Two number disks (104) are rotatably connected to the base (100) and the two number disks (104) set a pre-determined set of numbers to allow the locking frame on the engaging part (101) to disengaged form the base (100) by shifting the control button (105) on the base (100). In other words, when a user wants to open the cover (201), he/she has to use one hand to pull a tab (202) on the engaging part (101) and the other hand to shift the control button (105). It is convenient for the user when other stuff is held by his/her hand. Furthermore, the number disks (104) are accessible to anyone so that they could be changed or operated unintentionally or intentionally. Because the process for changing the codes set by operating the number disks (104) are similar for most of the suitcases in the market.

The present invention intends to provide a suitcase lock which can be opened by one hand and when changing the locking code, a tool such as a coin is needed to rotate a setting member then the user can change the locking code.

SUMMARY OF THE INVENTION

In accordance with one aspect of the present invention, a lock for a suitcase comprises an engaging part on the cover of the suitcase and a base on the base portion of the suitcase. The engaging part has a hook pivotally connected to the engaging part so that the hook is to be engaged with an aperture in the base. The base has a retaining member movably received therein and a pin extends from the retaining member. The pin movably extends in the aperture to engage with the hook.

A control frame is movably received in the base with two protrusions extending from the control frame. A connecting member is connected between the control frame and the retaining member. A spring has one end thereof fixedly connected to the base and the other end of the spring is engaged with the control frame. Two setting disks are rotatably connected to the base and each setting disk has a notch defined therein. The two protrusions are disengagably received in the two notches of the two setting disks while the pin of the retaining member is removed from the aperture. Two number disks are rotatably mounted to the two setting disks.

The primary object of the present invention is to provide a suitcase lock which allows the cover to be opened with one hand only.

Another object of the present invention is to provide a suitcase lock having a setting member which can be operated by a tool such as a coin or a screwdriver so as to re-set a new locking code.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
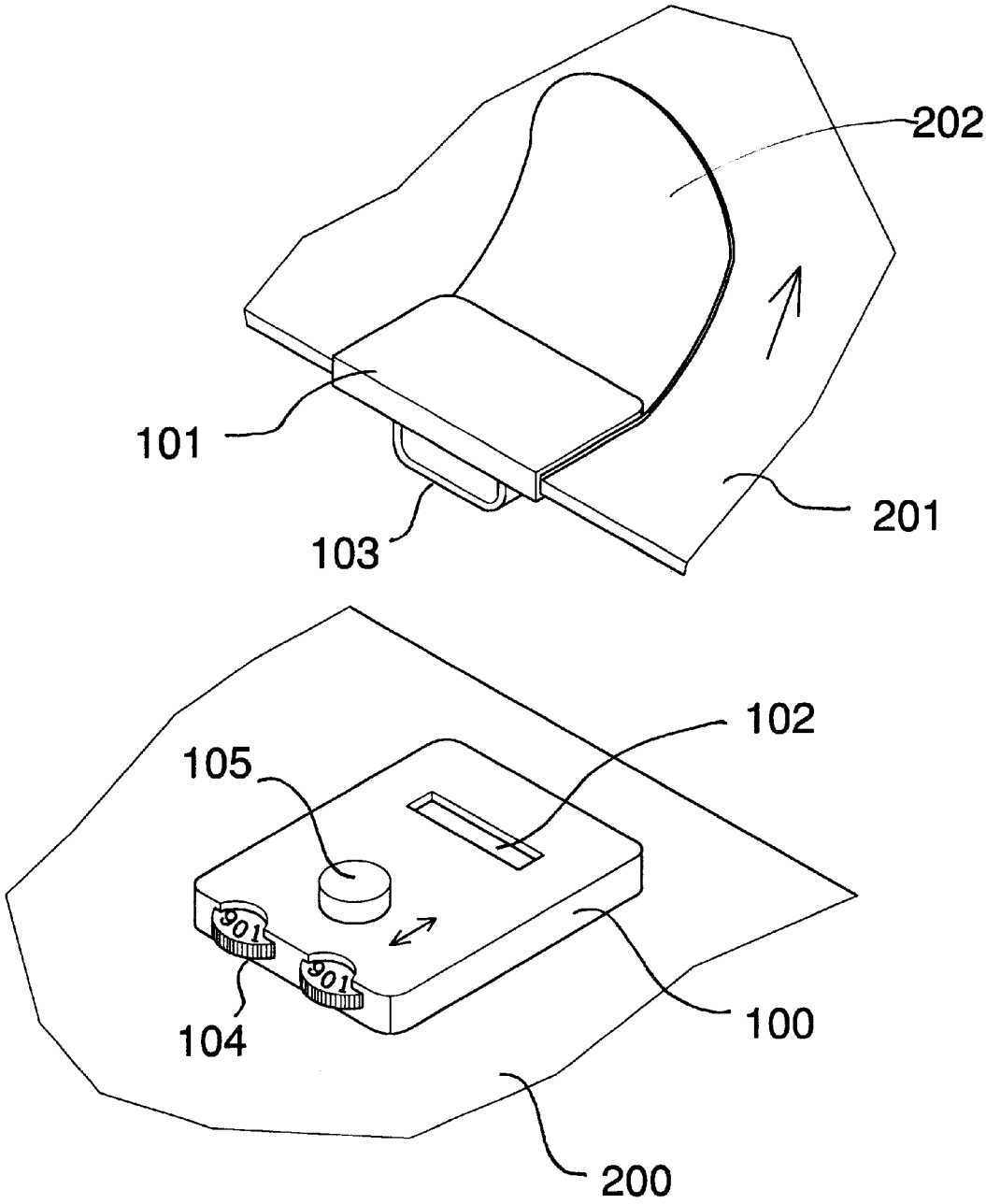
FIG.1 PRIOR ART
FIG. 1 is an exploded view of a conventional suitcase lock.
Figure 2:
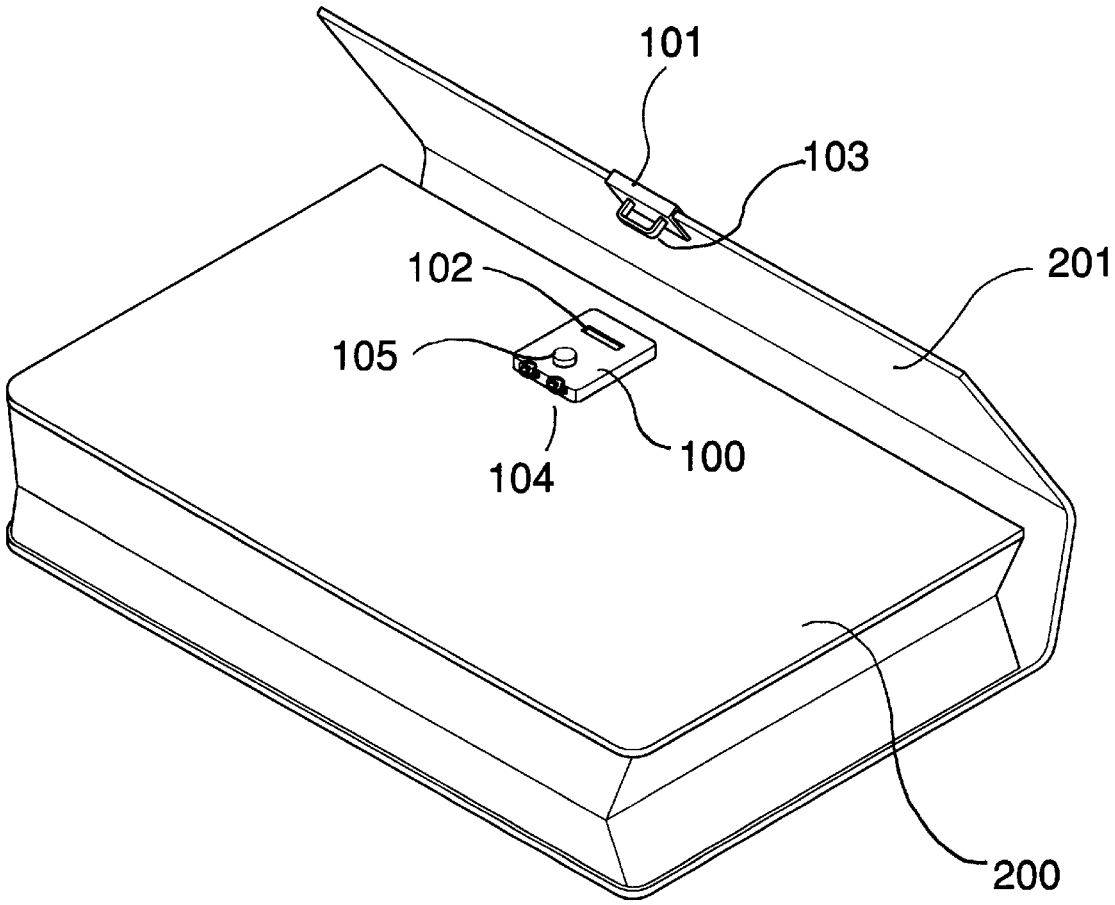
FIG.2 PRIOR ART
FIG. 2 is a perspective view of a suitcase having the conventional suitcase lock connected to the suitcase.
Figure 3:
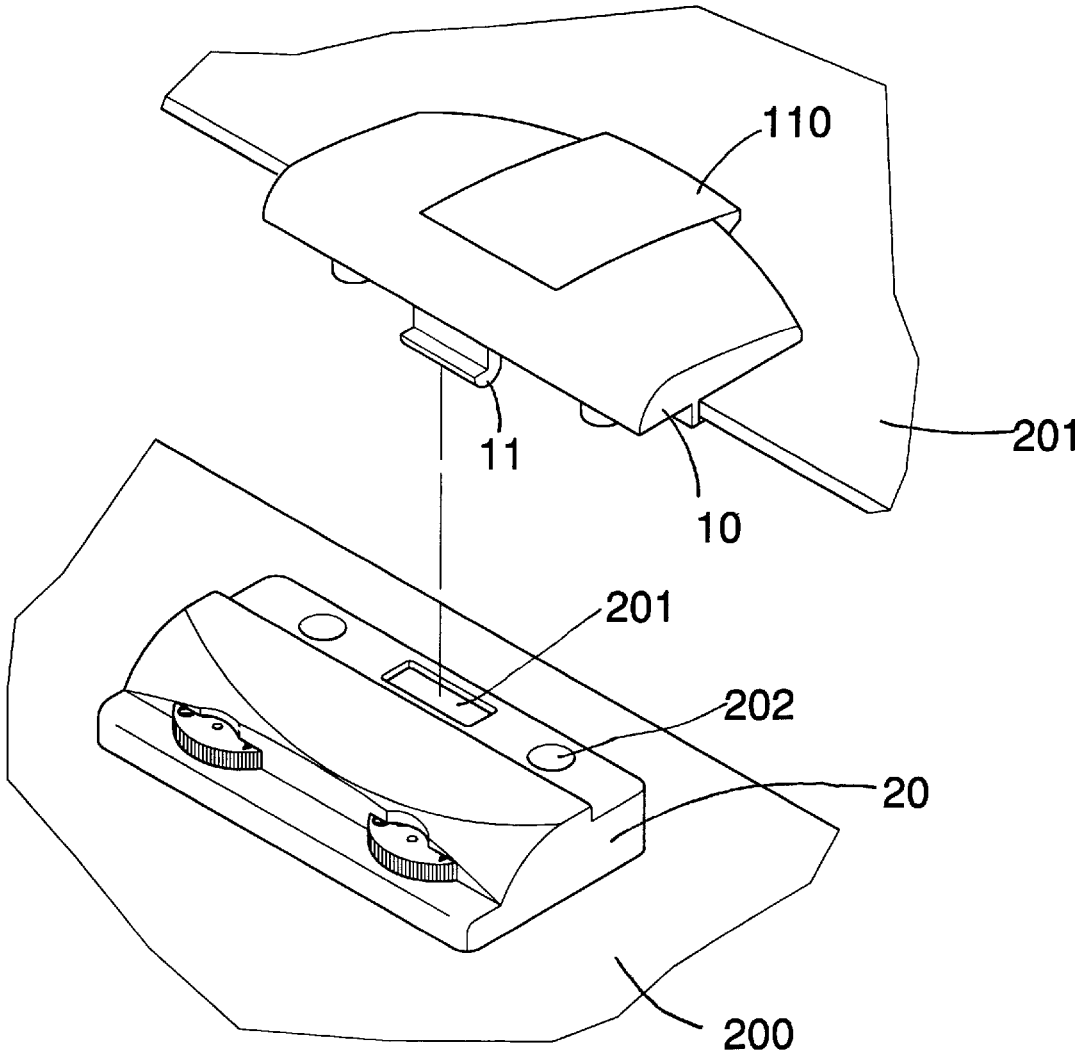
FIG. 3 is an exploded view of the suitcase lock in accordance with the present invention.
Figure 4:
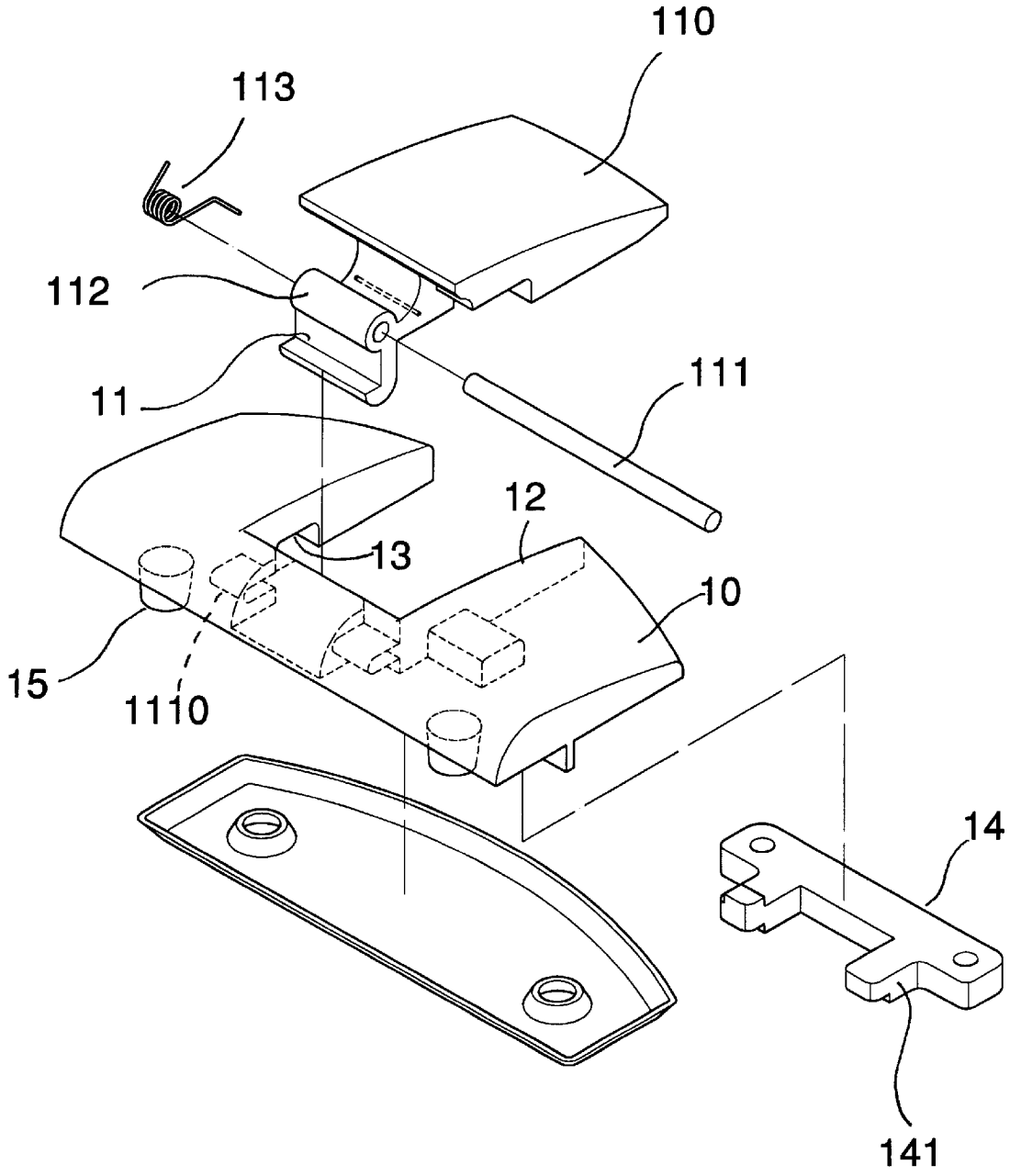
FIG. 4 is an exploded view of the engaging part of the suitcase lock in accordance with the present invention.

Referring to FIGS. 1 and 2, a suitcase includes a base portion (200) and a cover (201). The suitcase lock in accordance with the present invention comprises an engaging part (10) connected to the cover (201) and a base (20) connected to the base portion (200) of the suitcase. The engaging part (10) has a recess (12) defined in one of two sides thereof and a lever (110) is received in the recess (12). The lever (110) is connected to a hook (11) and is accessible from the outside of the engaging part (10). The hook (11) has a tube (112) connected thereto and a pin (111) extends through the tube (112) which has a tension spring (113) mounted thereto. The engaging part (10) has two holes (13) respectively defined in two sides of the periphery defining the recess (12), and two recesses (1110) are defined in the end connected between the two sides of the periphery defining the recess (12). The two ends of the pin (111) are inserted into the two recesses (1110). A limiting bar (14) is engaged between the two holes (13) and has two lugs (141) extending therefrom. The two lugs (141) contact the two ends of the pin (111) so as to prevent the hook (11) from separating from the engaging part (10). The engaging part

(10) has two insertions (15) extending therefrom which are engaged with two holes (202) defined in the base (20) when the engaging part (10) is mounted to the base (20).

Figure 7:
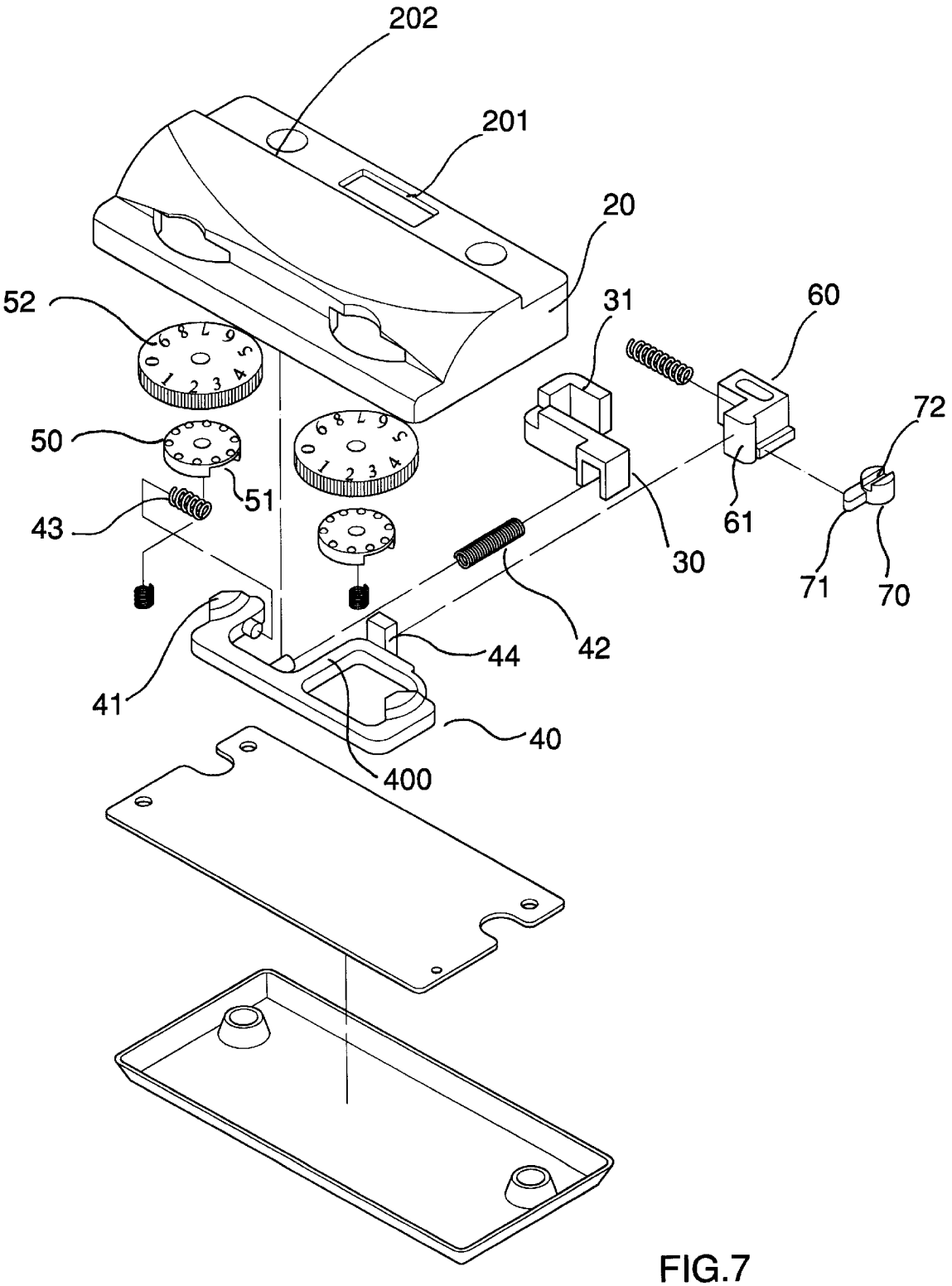
FIG. 7 is an exploded view of the base of the suitcase lock in accordance with the present invention.
Figure 8:
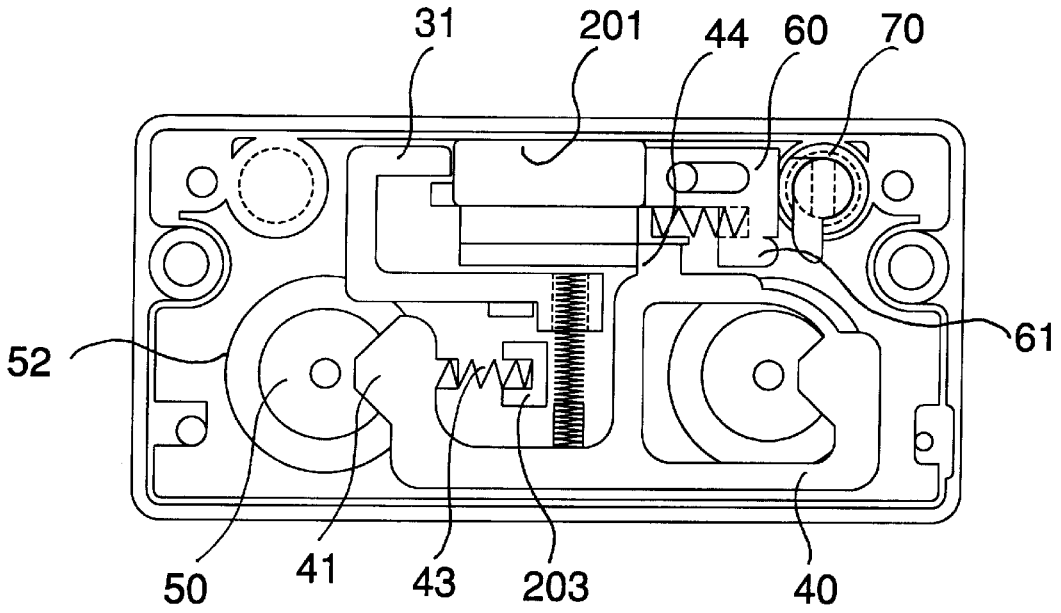
FIG. 8 is a side elevational view of the suitcase lock in accordance with the present invention, wherein the two protrusions of the control frame are received in the notches of the setting disks.
Figure 9:
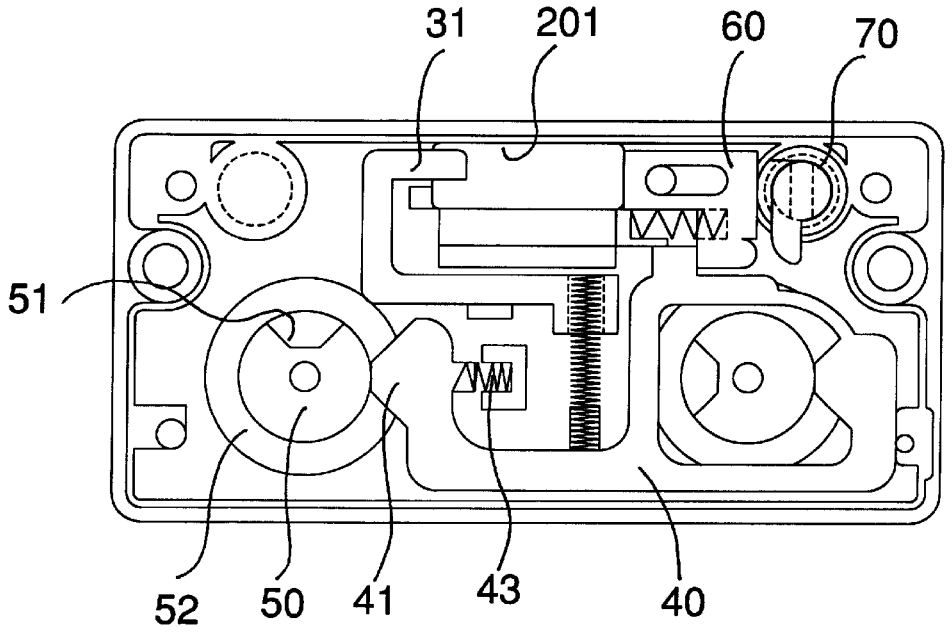
FIG. 9 is a side elevational view of the suitcase lock in accordance with the present invention, wherein the two protrusions of the control frame are pushed by rotating the setting disks and the pin of the retaining member extends in the aperture of the base.

Referring to FIGS. 7–9, the base (20) has an aperture (201) defined therein beside which the two holes (202) are located. A retaining member (30) is movably received in the base (20) and a pin (31) extends from the retaining member (30) so that when the hook (11) is received in the aperture (201) and the pin (31) is moved into the aperture (201), the hook (11) will be limited from disengaging from the aperture (201) so that the suitcase lock is locked.

A U-shaped control frame (40) is movably received in the base (20) and two protrusions (41) extend from the two distal ends of the control frame (40). An inverted L-shaped frame (400) extends from the mediated portion of the control frame (40) and is connected to one of the two distal ends, a lug (44) extending from the inverted L-shaped frame (400). A flexible connecting member (42) is connected between the control frame (40) and the retaining member (30). A spring (43) has one end thereof fixedly connected to a frame (203) extending from the base (20) and the other end of the spring (43) is engaged with one of the two distal ends of the control frame (40) so that the spring (43) tends to maintain the control frame (40) and the retaining member (30) at a location where the pin (31) of the retaining member (30) is not inserted into the aperture (201).

Two setting disks (50) are rotatably connected to the base (20) and each setting disk (50) has a notch (51) defined therein so that the two protrusions (41) are received in the two notches (51) of the two setting disks (50) when the user rotates the setting disks (50) to the right position. Two number disks (52) are respectively rotatably mounted to the two setting disks (50) so that when rotating the number disks (52), the two setting disks (50) are co-rotated with the number disks (52) if the setting disks (50) are not stopped.

A block (60) is movably connected to the base (20) and located beside the aperture (201). The block (60) has a thumb (61) extending therefrom.

Figure 5:
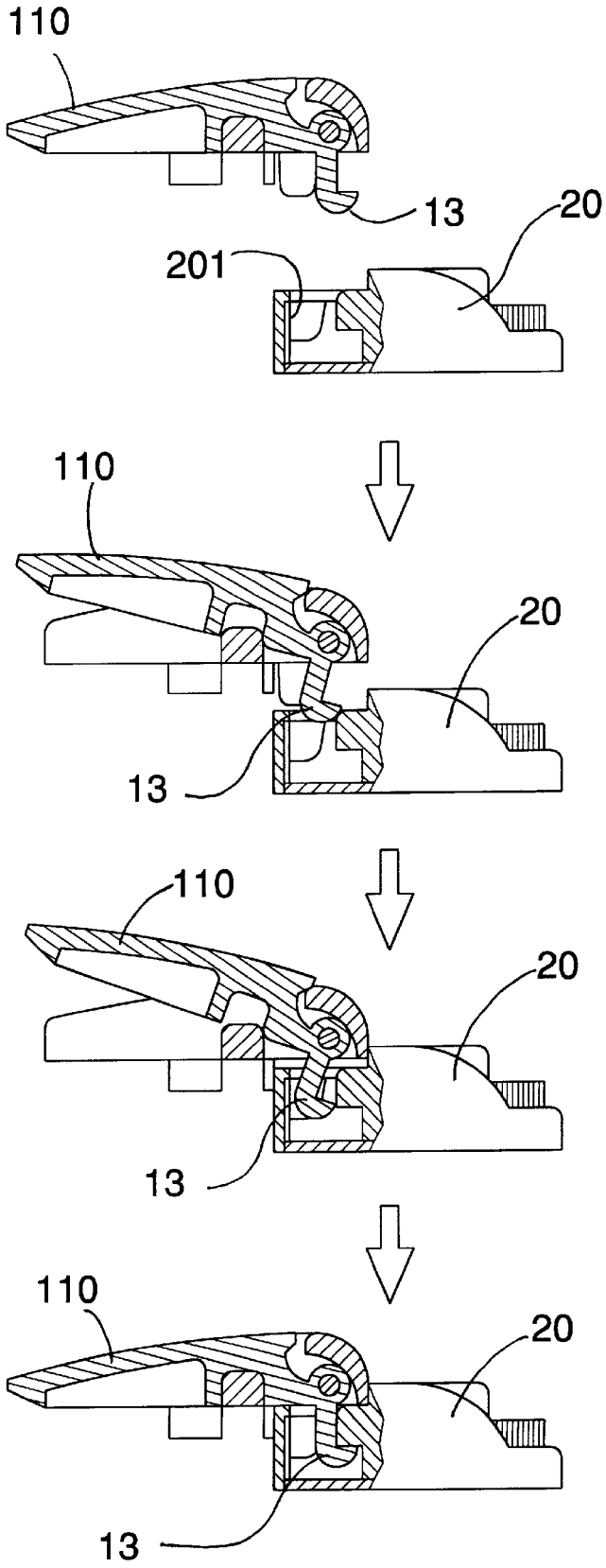
FIG. 5 is an illustrative view to show the actions that the engaging part is engaged with the base of the suitcase lock in accordance with the present invention.
Figure 6:
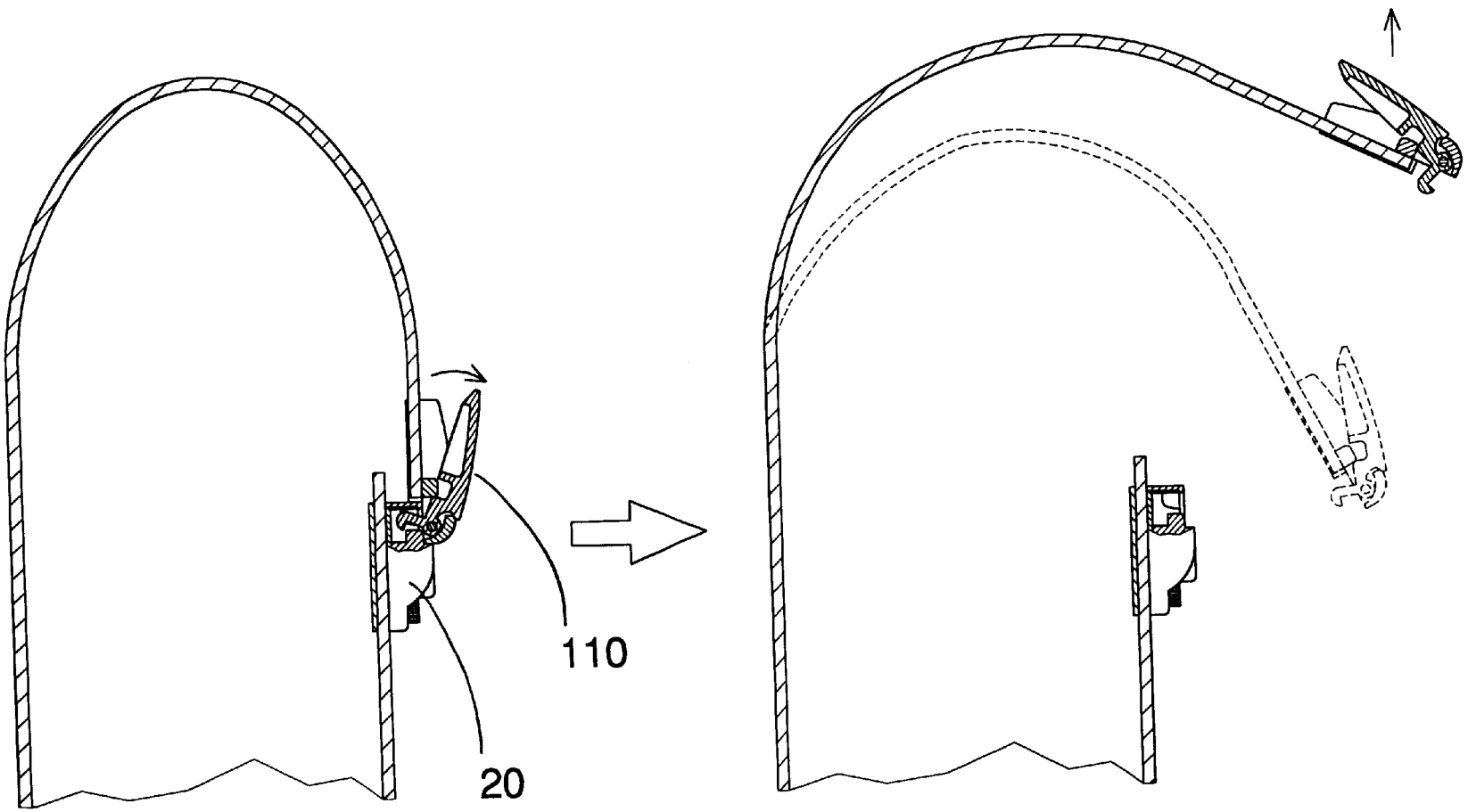
FIG. 6 is an illustrative view to show that the engaging part is disengaged from the base and the cover of the suitcase is opened.

Further referring to FIGS. 5 and 6, when closing the cover (201) to the base portion (200), simply pushing the engaging part (10) to the base (20) so that the hook (11) will be pivoted when the rounded end of the hook (11) contacts the periphery of the aperture (201) and the lever (110) is pivoted away from the engaging part (10). When the hook (11) is completely engaged with the aperture (201) and retained by the pin (31) of the retaining member (30), the lever (110) returns to its original position. If the user wants to open the cover (201), he/she simply pulls the lever (110) to let the hook (11) be removed from the pin (31) so that the cover (201) can be pulled away from the base portion (200). It is to be noted that the two insertions (15) on the engaging part (10) share the force to separate the engaging part (10) from the base (20) when a handle on the cover (201) is lifted. When the lock is locked, the number disks (52) together with the setting disks (50) are rotated, the two protrusions (41) are pushed by the periphery of the setting disks (50) so that the retaining member (30) connected to the control frame (40) is moved to let the pin (31) insert into the aperture (201) to limit the hook (11) from being removed from the aperture (201).

Figure 10:
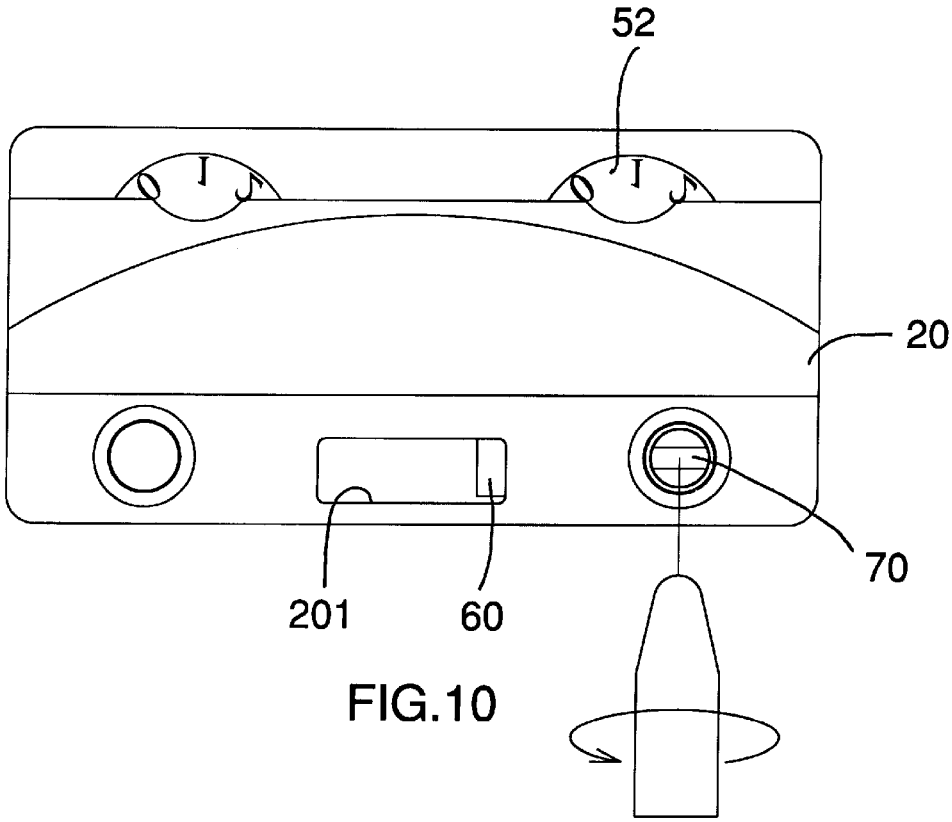
FIG. 10 shows a tool is used to rotate the setting member of the suitcase of the present invention.
Figure 11:
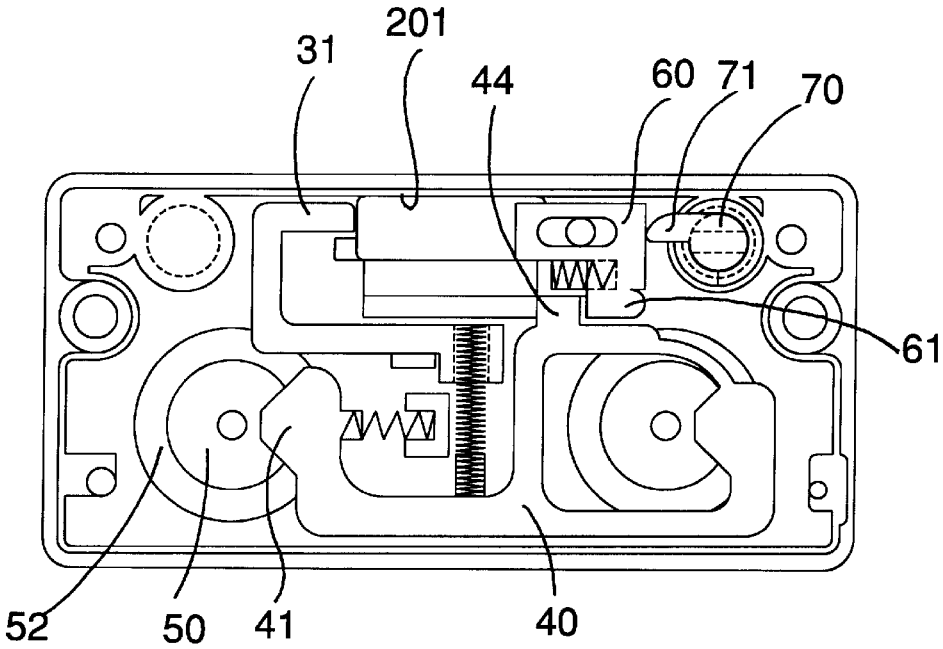
FIG. 11 is a side elevational view of the suitcase lock in accordance with the present invention, wherein the setting member is rotated to push the block to let the block insert into the aperture in the base.

Referring to FIGS. 7, 10 and 11, a setting member (70) is located beside the block (60) and has a cam member (71) extending therefrom which pushes the block (60) into the aperture (201) when the setting member (70) is rotated. The setting member (70) has a slit (72) defined therein so that when changing the locking code, the user may use a tool such as a coin or a screwdriver to insert the slit (72) and rotate the setting member (70) to rotate the cam member (71) to push the block (60) to let one end of the block (60) insert into the aperture (201). By this way, the user is informed that hook (11) cannot be engaged with the aperture (201). At this position, the two protrusions (41) are received in the two notches (51) of the two setting disks (50), and the lug (44) on the control frame (40) is stopped by the thumb (61) so that the control frame (40) will be positioned and the setting disks (50) are not rotated. Therefore, the user can rotate the two number disks (52) to set a new locking code. The setting member (70) is then rotated to its original position and the lock has a new locking code. Accordingly, the locking code will not be changed unintentionally if the setting member (70) is not rotated.

Figure 12:
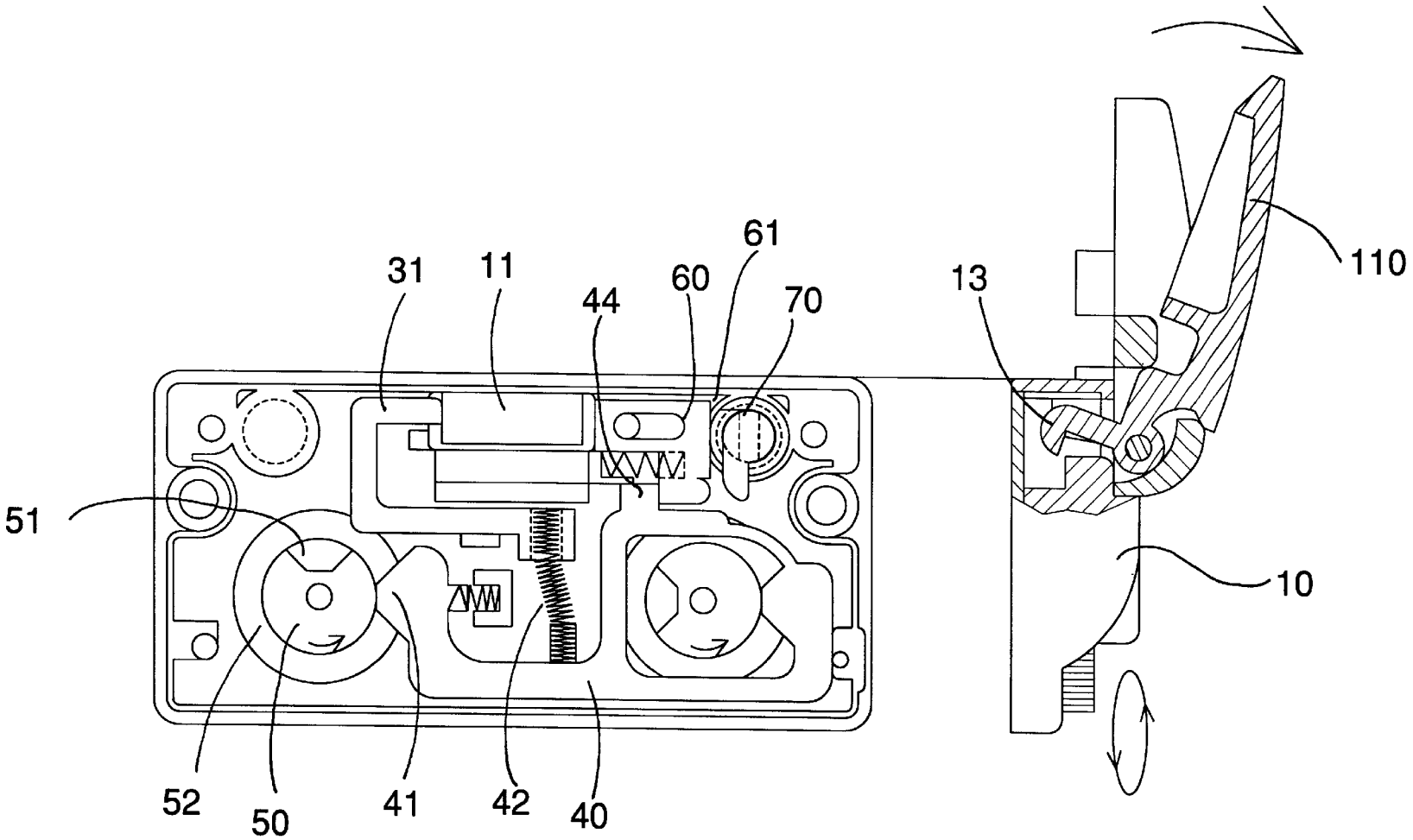
FIG. 12 shows if a person pulling the lever in the engaging part and rotates the number disk, the setting disks will be rotated with the number disks.

Referring to FIG. 12, a person cannot change the locking code while the hook (11) is retained in the aperture (201) by using a conventional way which does not rotate the setting member (70) and pulls the lever (110) and then rotates the number disks (52). The pin (31) is stopped by the hook (11) in the aperture (201) so that the retaining member (30) cannot be shifted even if the user rotates the number disks (52). Nonetheless, the connecting member (42) is flexible, so that the two protrusions (41) of the control frame (40) will be pushed by the setting disks (50) and the connecting member (42) is then deformed as shown. Therefore, the setting disks (50) are co-rotated with the number disks (52), so that the locking code cannot be changed by the conventional way.

While we have shown and described various embodiments in accordance with the present invention, it should be clear to those skilled in the art that further embodiments may be made without departing from the scope and spirit of the present invention.

What is claimed is:

1. A lock for a suitcase including a base portion (200) and a cover (201), said lock comprising:

an engaging part (10) adapted to be connected to the cover (201) and having a hook (11) pivotally connected to said engaging part (10), said engaging part (10) including two insertions (15) extending outward therefrom;

a base (20) having an aperture (201) defined therein for detachably receiving said hook (11), said base (20) defining two holes (202) each located beside said aperture (201) for receiving a respective one of said two insertions (15) when said engaging part (10) is mounted to said base (20), a retaining member (30) movably received in said base (20) and a pin (31) extending from said retaining member (30), said pin (31) movably extending into said aperture (201) to engage with said hook (11);

a control frame (40) movably received in said base (20) and two protrusions (41) each extending from said control frame (40), said control frame (40) having a lug (44) extending therefrom, a connecting member (42) connected between said control frame (40) and said retaining member (30), a spring (43) having a first end fixedly connected to said base (20) and a second end engaging with said control frame (40);

two setting disks (50) each rotatably connected to said base (20) and each having a notch (51) defined therein, each of said two protrusions (41) detachably received in said notch (51) of a respective one of said two setting disks (50);

two number disks (52) each respectively rotatably mounted to a respective one of said two setting disks (50);

a block (60) movably connected to said base (20) and located beside said aperture (201), said block (60) having a thumb (61) extending therefrom, wherein when said control frame (40) is shifted by rotating said setting disks (50) to remove said protrusions (41) of said control frame (40) from said notches (51) of said setting disks (50), said lug (44) of said control frame (40) is stopped by said thumb (61) of said block (60); and a setting member (70) located beside said block (60) and having a cam member (71) which pushes said block (60) into said aperture (201) when said setting member (70) is rotated.

2. The lock as claimed in claim 1, wherein said engaging part (10) has a recess (12) defined in one of two sides thereof and a lever (110) is received in said recess (12), said lever (110) connected to said hook (11) and being accessible from the outside of said engaging part (10).

3. The lock as claimed in claim 2, wherein said engaging part (10) has two holes (13) respectively defined in two sides of the periphery defining said recess (12), a limiting bar (14) engaged between said two holes (13) so as to prevent said hook (11) from separating from said engaging part (10).

4. The lock as claimed in claim 2, wherein said hook (11) has a tube (110) connected thereto and a pin (111) extends through said tube (110), said limiting bar (14) having two lugs (141) extending therefrom and said two lugs (141) contacting the two ends of said pin (111).

5. The lock as claimed in claim 1, wherein said setting member (70) has a slit (72) defined therein.

6. The lock as claimed in claim 1, wherein said connecting member (42) connected between said control frame (40) and said retaining member (30) is a flexible member.

* * * * *